US010098484B2

(12) United States Patent
Anderson et al.

(10) Patent No.: US 10,098,484 B2
(45) Date of Patent: Oct. 16, 2018

(54) MULTIPURPOSE INFANT TRAVEL BLANKET AND ASSOCIATED METHODS

(71) Applicants: Kell Garrison Anderson, Snohomish, WA (US); Stephena Lorraine Anderson, Snohomish, WA (US)

(72) Inventors: Kell Garrison Anderson, Snohomish, WA (US); Stephena Lorraine Anderson, Snohomish, WA (US)

( * ) Notice: Subject to any disclaimer, the term of this patent is extended or adjusted under 35 U.S.C. 154(b) by 226 days.

(21) Appl. No.: 14/993,302

(22) Filed: Jan. 12, 2016

(65) Prior Publication Data

US 2016/0198773 A1 Jul. 14, 2016

Related U.S. Application Data

(60) Provisional application No. 62/102,531, filed on Jan. 12, 2015.

(51) Int. Cl.

| | |
|---|---|
| ***A41D 11/00*** | (2006.01) |
| ***A47G 9/02*** | (2006.01) |
| ***A47G 9/06*** | (2006.01) |
| ***A47G 9/08*** | (2006.01) |

(52) U.S. Cl.

CPC ..... *A47G 9/0223* (2013.01); *A41D 11/00* (2013.01); *A47G 9/068* (2013.01); *A47G 9/083* (2013.01)

(58) Field of Classification Search

CPC ..... A47G 9/0223; A47G 9/068; A47G 9/083; A41D 11/00

See application file for complete search history.

(56) References Cited

U.S. PATENT DOCUMENTS

| | | | | |
|---|---|---|---|---|
| 6,145,932 | A * | 11/2000 | Hamel-Nyhus | A47D 15/006 297/219.12 |
| 6,272,683 | B1 * | 8/2001 | Symms | A41B 13/06 2/69.5 |
| 2003/0193221 | A1 * | 10/2003 | Hoey-Slocombe | A47G 9/068 297/184.13 |
| 2004/0217633 | A1 * | 11/2004 | Kassai | A47D 15/006 297/219.12 |
| 2005/0210585 | A1 * | 9/2005 | French | A41B 13/06 5/494 |
| 2011/0180079 | A1 * | 7/2011 | Krawchuk | A41B 13/06 128/873 |
| 2012/0284897 | A1 * | 11/2012 | Fair | A47G 9/068 2/69.5 |
| 2014/0033430 | A1 * | 2/2014 | Daugherty | A41B 13/06 5/494 |

* cited by examiner

*Primary Examiner* — Khaled Annis
(74) *Attorney, Agent, or Firm* — Lathrop Gage LLP

(57) ABSTRACT

A multipurpose infant travel blanket and manufacturing method are disclosed. A material is folded such that a first edge and a second edge, opposite the first edge, of the material meet. A zipper, when closed, holds together a part of the first edge and a corresponding part of the second edge. A first seam joins remaining parts of the first and second edges and a second seam is formed along a bottom edge of the material to form a pocket for protecting an infant. Loops are attached to an inner surface of the material, between the edges and folds, and are capable of securing the multipurpose infant travel blanket to an infant travel device. One or more cinch mechanisms formed on the outer surface of the material may be used to resize the pocket.

9 Claims, 7 Drawing Sheets

MULTIPURPOSE INFANT TRAVEL BLANKET AND ASSOCIATED METHODS

RELATED APPLICATIONS

This application claims priority to U.S. Patent Application Ser. No. 62/102,531 titled "Multipurpose Infant Travel Blanket and Associated Methods", filed Jan. 12, 2015, and incorporated herein by reference.

FIELD OF THE INVENTION

This invention relates to a blanket that can be secured to an infant travel device without hindering security of the travel device and safety of the infant.

BACKGROUND

There are many known ways to protect an infant during travel in infant travel devices (e.g., carriers and car seats). Most of these ways use specific items that function with only one infant travel device. One example is the "cold weather boot" that is sold with many car seats. Other items fasten to a car seat but interfere with the seat's straps by adding unnecessary bulk between the infant and the strap, putting the car seat's warranty coverage and the infant's safety into danger. Some car seat covers require the straps to be threaded through the blanket, which is also time-consuming and cannot be removed without removing the infant.

SUMMARY

In one embodiment, a multipurpose infant travel blanket includes a material with a first edge and a second edge opposite the first edge. The material has a first and second fold such that the first and second edges meet. A zipper is attached to a part of the first edge and a corresponding part of the second edge such that, when the zipper is closed, the first and second edges are held together. A first seam joins a part of the first edge and a corresponding part of the second edge and extends from the zipper to a second seam formed along a bottom edge of the folded material such that the first and second seams and closed zipper form a pocket within the material for protecting an infant. A first loop is attached to an inner surface of the material between the first edge and the first fold, and a second loop is attached to the inner surface of the material between the second edge and the second fold. The first and second loops are capable of securing the multipurpose infant travel blanket to an infant travel device.

In another embodiment, a method manufactures a multipurpose infant travel blanket. A material is folded at a first and second fold such that a first edge and a second edge, opposite the first edge, of the material meet. A zipper is attached to a part of the first edge and a corresponding part of the second edge such that when the zipper is closed the first and second edges are held together. A first seam is formed to join a part of the first edge and a corresponding part of the second edge where the first and second edges are not attached to the zipper. A second seam is formed proximate one end of the first seam and along a bottom edge of the material, such that the first and second seams and the closed zipper form a pocket within the material for protecting an infant. A first loop is attached to an inner surface of the material between the first edge and the first fold, and a second loop is attached to the inner surface of the material between the second edge and the second fold.

DETAILED DESCRIPTION OF THE EMBODIMENTS

Figure 1:
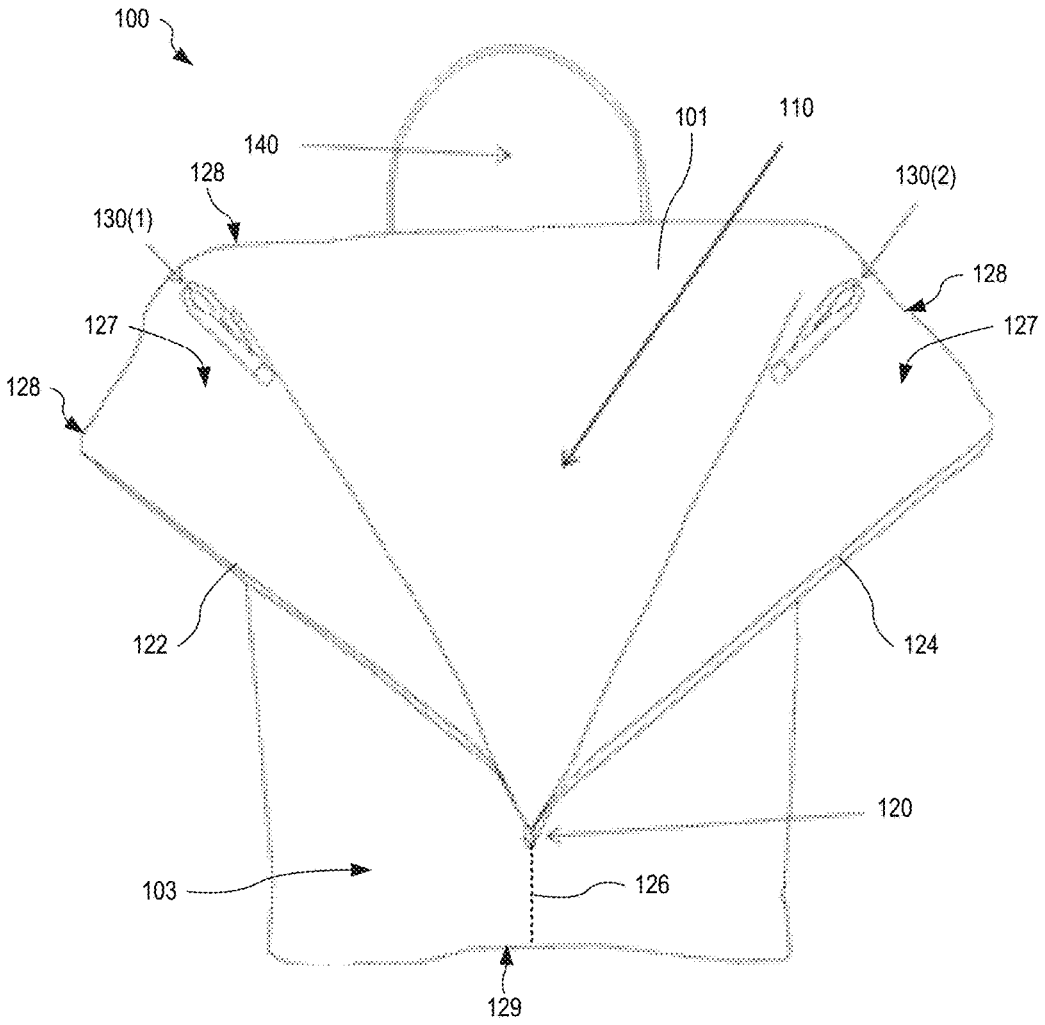
FIG. 1 is a first view of one exemplary multipurpose infant travel blanket with an optional hood attached, in an embodiment.
Figure 2:
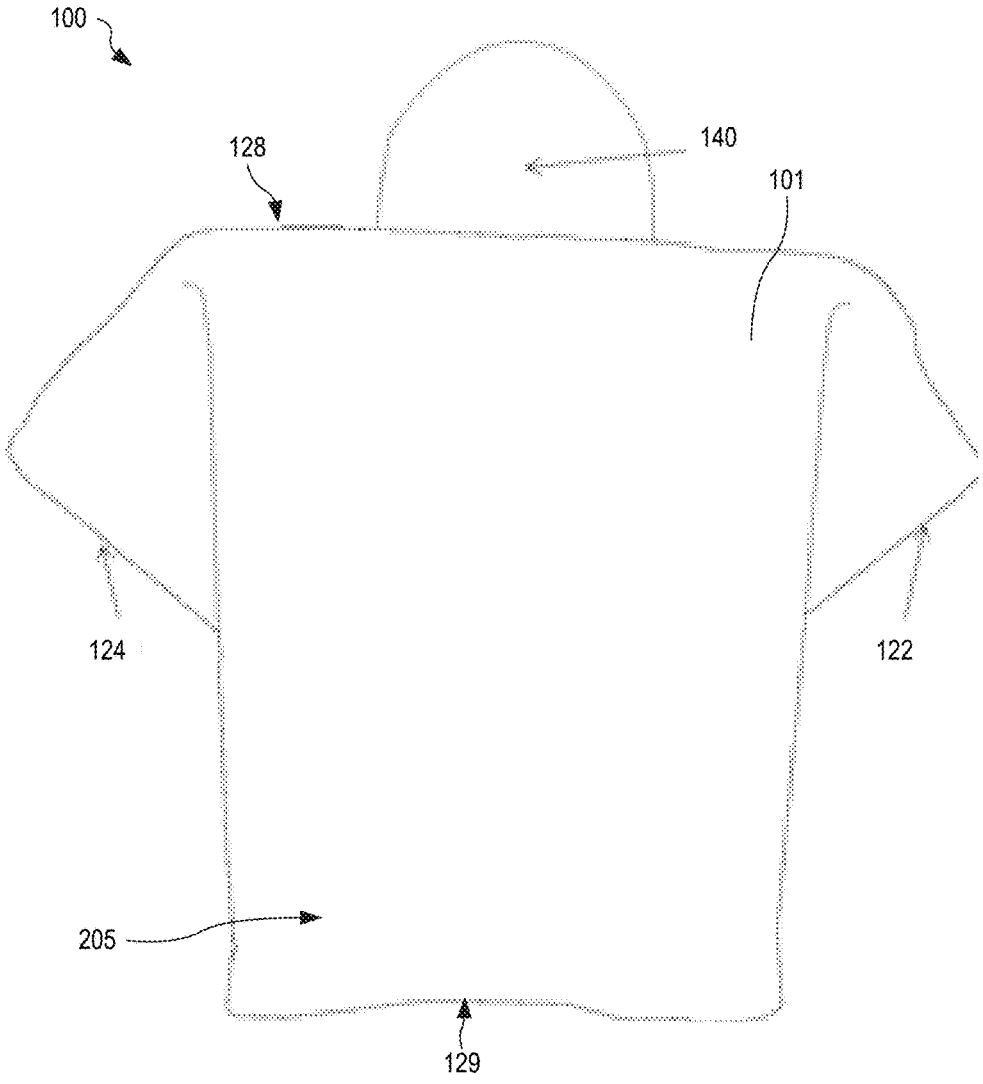
FIG. 2 is a second view, opposite the first view, of the multipurpose infant travel blanket of FIG. 1.

FIG. 1 is a first view of one exemplary multipurpose infant travel blanket 100 with an optional hood 140. FIG. 2 is a second view, opposite the first view, of the multipurpose infant travel blanket of FIG. 1. FIGS. 1 and 2 are best viewed together with the following description.

Multipurpose infant travel blanket 100 is constructed of a layered material 101 that is sewn together for example. In an embodiment, material 101 has an outer cover made of cloth or weather-resistant material, a middle layer made of an insulating material, and an inner lining of cloth or other similar material. In another embodiment, material 101 has an outer cover made of a weather-resistant material and an inner layer made of lamb skin or similar material. More or fewer layers may be used without departing from the scope hereof. Layered material 101 wraps around to form a pocket 110 and a bottom edge 129 that is sewn together. Multipurpose infant travel blanket 100 may be used safely and easily with different infant travel devices, such as a car seat, stroller, and carrying harness. Multipurpose infant travel blanket 100 is made of materials that are selected to keep the infant warm while blocking wind, rain, dust, and the sun's harmful rays. For example, one or more layers of material 101 may be selected to provide certain types of protection from the environment.

Material 101 meets to form a first side 103 and is partially sewn together, shown as a seam 126. A zipper 120 is used to close together left and right sides 122, 124 to form pocket 110 into which the infant is placed for protection. Seam 126 and zipper 120 together may run from a top edge 128 to bottom edge 129 of multipurpose infant travel blanket 100. Zipper 120 allows first side 103 to be opened as described in further detail below.

Within pocket 110, two loops 130(1) and 130(2) are attached (e.g., sewn to the inner lining) to an inner surface 127 of first side 103 as shown. Each loop 130 may be formed of cloth or similar material and may be opened and closed using a fastener such as a loop-and-hook fastener (e.g., VELCRO®), snap fastener, and/or by tying two ends together.

Optionally, hood 140 may be attached to multipurpose infant travel blanket 100 at a second side 205 (see FIG. 2) opposite first opening side 103. Hood 140 is for example made of a material similar to, or the same as, material 101 and attaches to a top edge 128 using one or more of a snap, zipper, and loop-and-hook fastener (e.g., VELCRO®). Hood 140 may attach to provide more coverage of the infant while adding protection from the environment. Hood 140 is removed when second side 205 of blanket 100 is proximate the infant's front such that hood 140 does not present a suffocation risk to the infant. When the second side 205 of blanket 100 is proximate the infant's back, hood 140 may be attached and used to cover the infant's head.

When used as a standalone blanket to carry an infant, zipper 120 is closed while the infant is within pocket 110. Multipurpose infant travel blanket 100 then attaches to an infant travel device as needed. Multipurpose infant travel blanket 100 may be used as a car seat cover (see FIG. 5 and accompanying description) for different infant car seat models without voiding warranty of the car seat manufacturer, since no modification of the car seat is required and since blanket 100 does not interfere with the intended operation and function of the car seat. Blanket 100 may be detached from the car seat (or other infant travel device) to remain with the infant when the infant is removed from the car seat, thereby avoiding any need for additional blankets or coverings. Size and positioning of zipper 120 and the shape of pocket 110 facilitates safe configuration of blanket 100 around securing elements of the infant travel device while providing protection to the infant. Loops 130 are optimally sized and positioned to facilitate securing and retaining of blanket 100 to the infant travel device without interfering with security and safety of the infant travel device and such that blanket 100 remains positioned to protect the infant. Multipurpose infant travel blanket 100 may also attach to a stroller (see FIG. 6), a carrying harness (see FIG. 7), and may have many additional uses.

Figure 3:
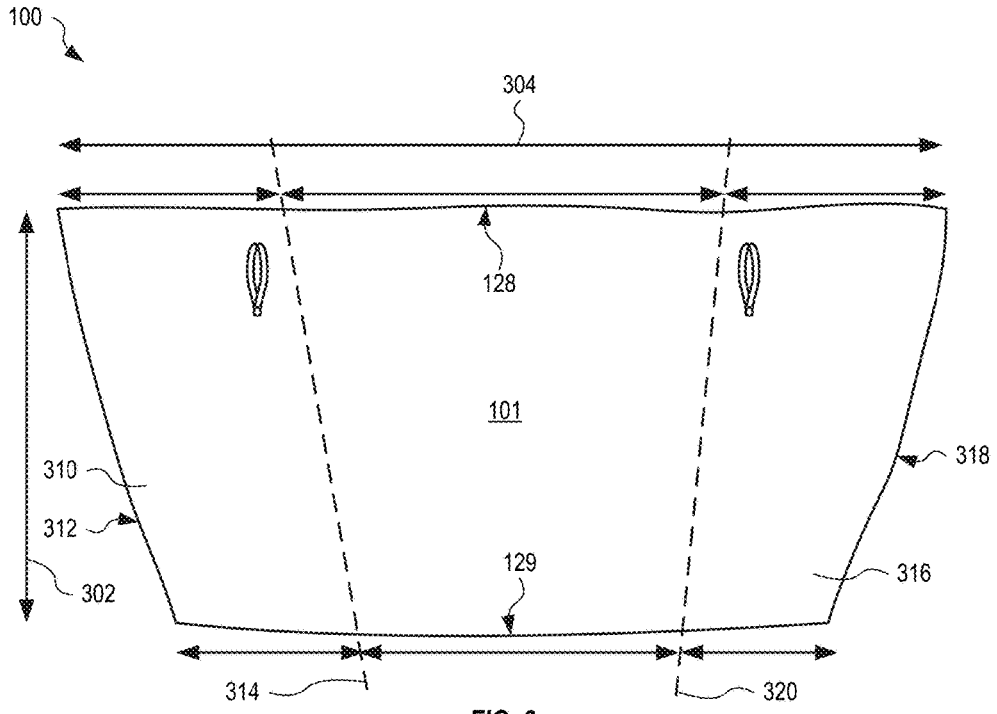
FIG. 3 shows material of the multipurpose infant travel blanket of FIG. 1 prior to forming the pocket.
Figure 4:
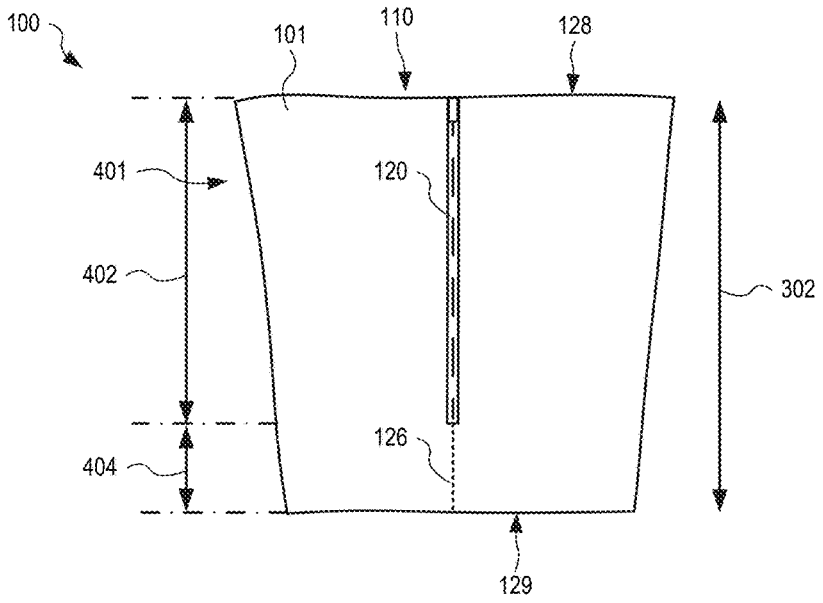
FIG. 4 shows the multipurpose infant travel blanket of FIG. 1 with the zipper closed.

FIG. 3 shows material 101 of multipurpose infant travel blanket 100 of FIG. 1 prior to sewing seam 126 and closing of zipper 120 to form pocket 110. FIG. 4 shows the multipurpose infant travel blanket 100 of FIG. 1 formed by sewing material 101 at bottom edge 129 and seam 126, and with zipper 120 closed. FIGS. 3 and 4 are best viewed together with the following description. In an embodiment, material 101 is tapered such that bottom edge 129 is shorter than top edge 128, and such that pocket 110, when formed, is also tapered. See FIG. 8 for example. However, material 101 and pocket 110 may be rectangular or otherwise shaped without departing from the scope hereof. Height 302 and width 304 of material 101 is selected such that pocket 110 comfortably and safely accommodates an average sized infant for which multipurpose infant travel blanket 100 is intended to protect. Alternatively, multipurpose infant travel blanket 100 may be specifically sized for different age ranges.

To form pocket 110, a first portion 310 of material 101 having a first edge 312 is folded along fold line 314 and a second portion 316 having a second edge 318 is folded along a fold line 320. When folded, edges 312 and 318 meet to form seam 126 and to allow zipper 120 to be added to at least part of edges 312 and 318.

Zipper 120 has a length 402 and seam 126 has a length 404, where the sum of lengths 402 and 404 are substantially the same as height 302. The ratio of length 402 to length 404 is may vary based upon the size of the infant relative to the length of blanket 100.

Figure 5:
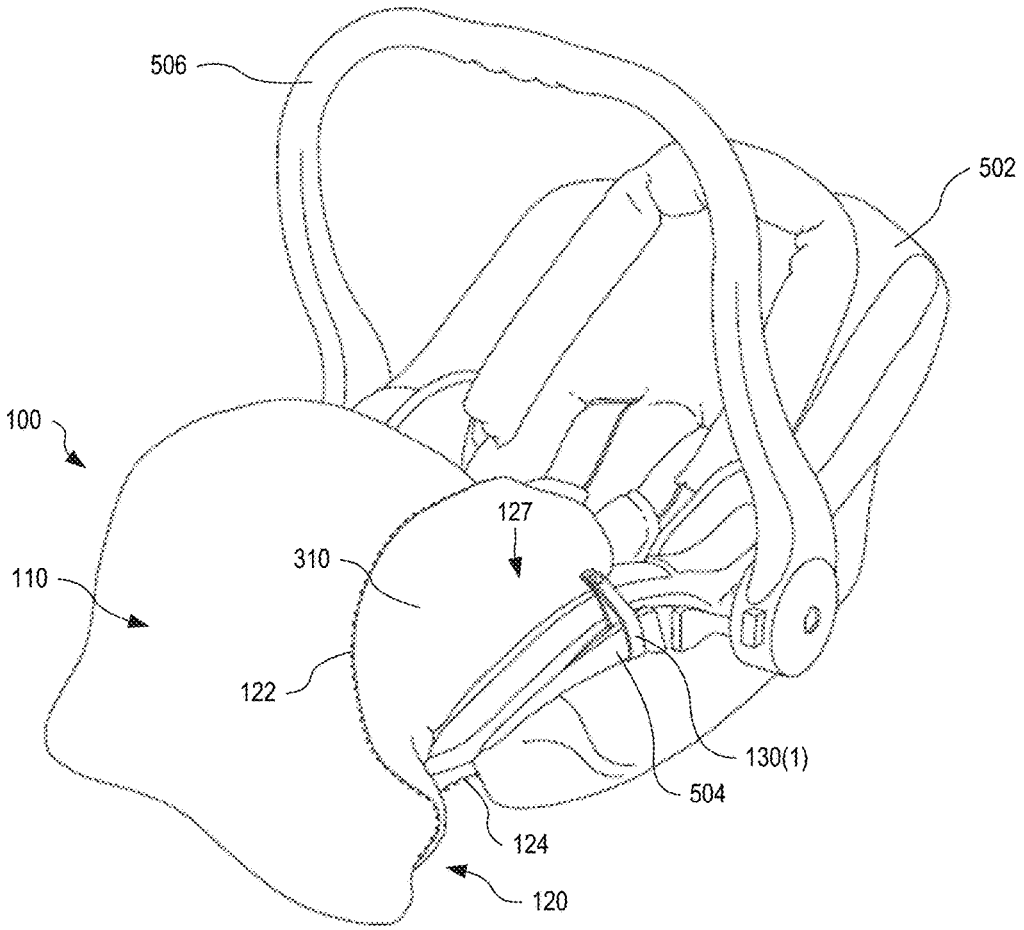
FIG. 5 shows the multipurpose infant travel blanket of FIG. 1 configured with an infant car seat.

FIG. 5 shows multipurpose infant travel blanket 100 of FIG. 1, without optional hood 140, configured with an infant car seat 502. The infant is placed directly into car seat 502 and secured using restraints of the car seat in accordance with the safety instructions of the car seat. Multipurpose infant travel blanket 100 is positioned such that second side 205 (opposite zipper 120) is upper most and zipper 120 is fully opened such that blanket 100 is covering the front of the infant and no part of the blanket interferes with security (e.g., straps) of car seat 502. Each loop 130 is secured to a different vehicle belt hook 504 of car seat 502 and does not interfere with securing of car seat 502 within a vehicle. In the example of FIG. 5, first portion 310 of material 101 is folded back to reveal inner surface 127, left and right sides 122, 124 and zipper 120 of blanket 100 to show attachment of loop 130(1) to vehicle belt hook 504.

In one example of placing the infant within car seat 502, while the infant is within pocket 110, zipper 120 is at least partially opened and the infant is placed within car seat 502 such that the bottom of blanket 100 remains over the infant's feet. Multipurpose infant travel blanket 100 is then fastened to the car seat by securing loops 130 to one or more of vehicle belt hooks 504, carrying handle 506, and/or other safe locations of car seat 502. In one example of removing the infant from car seat 502, loops 130 are unfastened from car seat 502 and straps securing the infant within car seat 502 are undone while the bottom of blanket 100 is still encasing the infant's feet. The infant is then lifted slightly out of car seat 502 and zipper 120 is closed behind the infant, converting multipurpose infant travel blanket 100 for carrying the infant.

Figure 6:
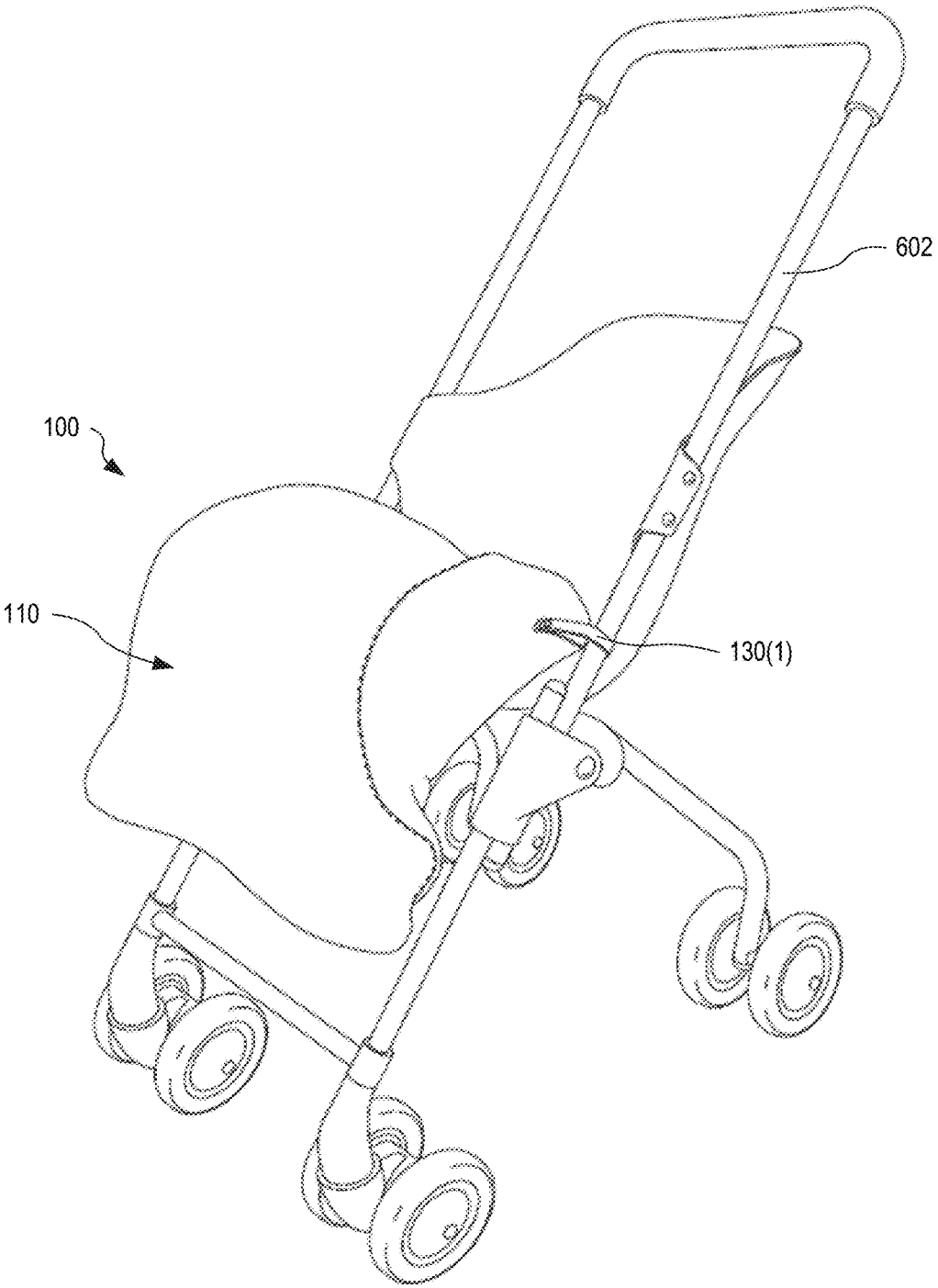
FIG. 6 shows the multipurpose infant travel blanket of FIG. 1 configured with a stroller.

FIG. 6 shows the multipurpose infant travel blanket of FIG. 1 configured with a stroller 602. Second side 205 (opposite zipper 120) of blanket 100 is positioned to face up and positioned such that the infant is within pocket 110 while zipper 120 is open. Loops 130 are used to secure blanket 100 to framework of stroller 602 and function to keep blanket 100 in position without interfering with security and safety of stroller 602.

In one example of using blanket 100 with stroller 602, the infant is secured into stroller 602 as per the stroller's instruction manual. Zipper 120 is opened and blanket 100 is positioned with the infant's feet inside pocket 110 and second side 205 facing up. Loops 130 are then secured to a safe place on the frame of stroller 602 to keep blanket 100 in position.

Figure 7:
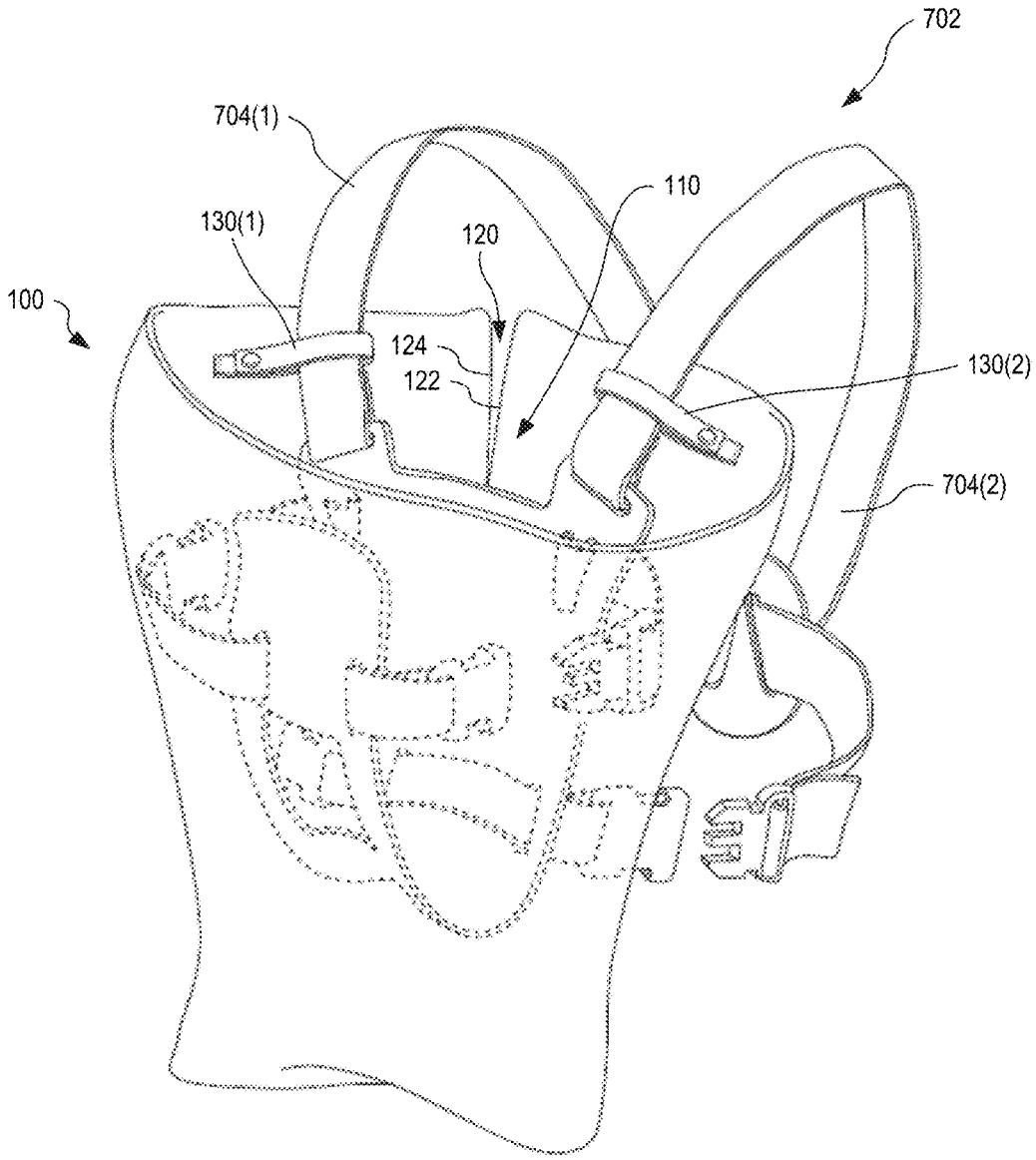
FIG. 7 shows exemplary use of the multipurpose infant travel blanket of FIG. 1 configured with a carrying harness.

FIG. 7 shows exemplary use of the multipurpose infant travel blanket of FIG. 1, without optional hood 140, to protect the infant in a carrying harness 702. In this configuration, zipper 120 is at least partially open to accommodate the infant and carrying harness 702. Loops 130 are secured around one or more straps 704 of carrying harness 702 to keep multipurpose infant travel blanket 100 in place around the infant.

In one example of configuring multipurpose infant travel blanket 100 for use with carrying harness 702, carrying harness 702 is donned by an adult and the infant is secured into the carrying harness in accordance with the manufacturer's instruction manual. Zipper 120 of multipurpose infant travel blanket 100 is opened and positioned with first side 103 (zipper 120 side) towards the adult's front, pocket 110 is placed over the infant's feet and blanket 100 is lifted up to enshroud the infant's body. The open zipper 120 allows blanket 100 to divide around carrying harness 702. Once positioned around the infant, loops 130 are looped around convenient straps 704 of carrying harness 702 to secure blanket 100 in position. Loops 130 may attach to any portion of carrying harness 702 that is safe and operate to prevent the top portion 401 (see FIG. 4) of blanket 100 from falling. To detach blanket 100, loops 130 are detached from carrying harness 702 and blanket 100 may be pulled downward and then removed completely. The adult is then free to remove the infant and doff carrying harness 702.

Optional hood 140 is recommended for use when multipurpose infant travel blanket 100 is used stand-alone or when used with carrying harness 702. Hood 140 detaches for safety of the infant when second side 205 of blanket 100 is facing the front of the infant to prevent incidences of suffocation.

Figure 8:
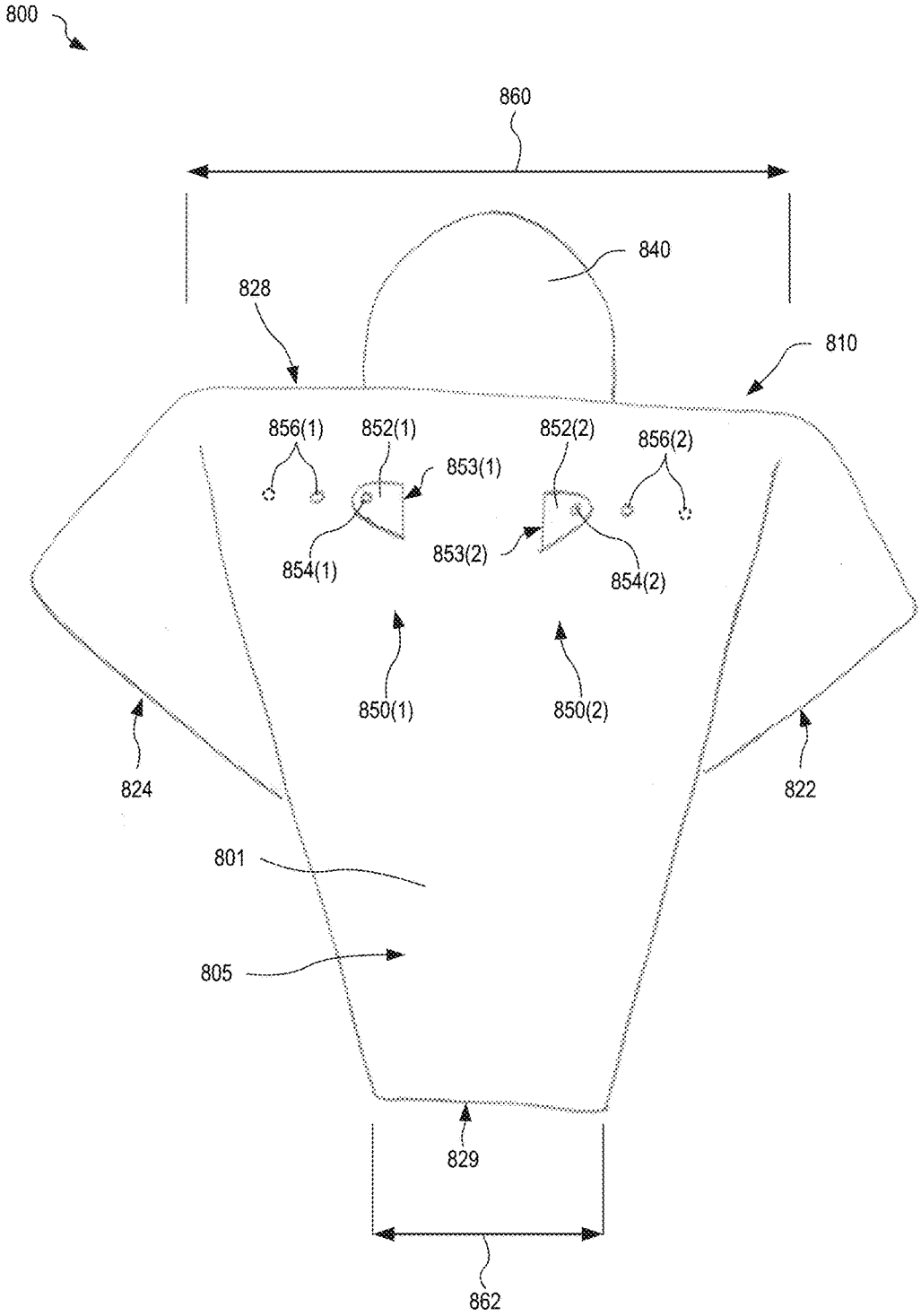
FIG. 8 shows an exemplary multipurpose infant travel blanket with tapered pocket, an optional hood, and cinching mechanism, in an embodiment.

FIG. 8 shows an exemplary multipurpose infant travel blanket 800 with tapered pocket 810, an optional hood 840, and cinching mechanism 850. Blanket 800 is similar to blanket 100 of FIGS. 1-7. For example material 801 is similar to material 101, having a top edge 828 that is similar to top edge 128, a bottom edge 829 that is similar to bottom edge 129, a left side 822 that is similar to left side 122, and a right side 824 that is similar to right side 124. Left side 822 and right side 824 may be fastened together, using a zipper, Velcro®, ties, buttons, or other such fastening means. Blanket 800 may include an optional hood 840 that is similar to hood 140 of blanket 100. Blanket 800 forms a pocket 810, similar to pocket 110 formed by blanket 100, and may include loops (not shown) attached within pocket 810 that are similar to loops 130(1) and 130(2) of blanket 100.

As shown in FIG. 8, blanket 800 is formed such that a top opening of pocket 810 has a width 860 that is greater than a bottom width 862 of pocket 810. Thus, sides of pocket 810 taper such that pocket 810 is narrower at the bottom (proximate bottom edge 829) as compared to the top (proximate top edge 828 and optional hood 840) of pocket 810.

Cinching mechanism 850 is formed on an outer surface 805 (i.e., outside of pocket 810) of blanket 800 and includes a fabric tab 852, attached to material 801 at edge 853, that has a first fastening device 854 coupled thereto and one or more matching second fastening devices 856 attached to the outer surface 805 of material 801. Fabric tab 852 and second fastening device 856 are positioned such that when first and second fastening devices 854, 856 are coupled together, a portion of material 801 is folded to form a cinch, thereby reducing width 860 of pocket 810. Multiple second fastening devices 856 may be provided at different distances from fabric tab 852 such that the cinched amount of material 801 may be varied by the user to select a desired size for pocket 810.

As shown in FIG. 8, blanket 800 has two separate cinching mechanisms 850(1) and 850(2) that may be used independently or together to vary the width (e.g., width 860) of pocket 810 as desired to suit the intended use. Fastening devices 854 and 856 are selected from the group of fasteners including snaps, poppers, buttons and button holes, loops and hooks, and so on. Cinching mechanism 850 may be formed using other devices such as elastic, cording, hook and pile tape, and other similar devices without departing from the scope hereof. One or more cinching mechanisms 850 may be incorporated with blanket 100 of FIG. 1 to allow adjustment to the width of pocket 110.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A multipurpose infant travel blanket, comprising:

a material having a first edge and a second edge opposite the first edge, the material having a first and second fold such that the first and second edges meet;

a zipper attached to a part of the first edge and a corresponding part of the second edge such that, when the zipper, is closed the first and second edges are held together;

a first seam joining a part of the first edge and a corresponding part of the second edge, the first seam extending from the zipper to a second seam formed along a bottom edge of the folded material such that the first and second seams and closed zipper form a pocket within the material for protecting an infant;

a first loop attached to an inner front surface of the material that is inside the pocket with zipper closed and between the first edge and the first fold adjacent a front region of an infant when worn; and a second loop attached to the inner front surface of the material that is inside the pocket with zipper closed and between the second edge and the second fold adjacent the front region of the infant when worn;

wherein the first and second loops are capable of securing the multipurpose infant travel blanket to an infant travel device.

2. The multipurpose infant travel blanket of claim 1, the multipurpose infant travel blanket being configured to not inhibit safety of an infant being transported by the infant travel device, when the multipurpose infant travel blanket is secured to the infant travel device.

3. The multipurpose infant travel blanket of claim 1, the material comprising a plurality of material layers selected to protect the infant from undesired environmental conditions.

4. The multipurpose infant travel blanket of claim 3, a first of the material layers comprising an outer cover including a weather-resistant material and a second of the material layers comprising an inner layer including an insulating material.

5. The multipurpose infant travel blanket of claim 1, further comprising at least one cinching mechanism positioned on an outer surface, opposite the inner surface, of the material such that the material may be cinched to reduce a width of the pocket.

6. The multipurpose infant travel blanket of claim 1, wherein the pocket is tapered such that a top opening is wider than the bottom edge.

7. The multipurpose infant travel blanket of claim 1, the infant travel device being configurable for operation with a carrying harness wherein the first and second loops attach to different shoulder straps of the carrying harness.

8. The multipurpose infant travel blanket of claim 1, the infant travel device being configurable for operation with a stroller wherein the first and second loops attach to framework of the stroller such that an infant secured within the stroller is positioned within the pocket.

9. The multipurpose infant travel blanket of claim 1, the infant travel device being configurable for operation with an infant car seat wherein the first and second loops attach to different vehicle belt hooks of the infant car seat such that an infant secured within the infant car seat is positioned within the pocket.

* * * * *